US009570058B2

(12) United States Patent
Umeo

(10) Patent No.: US 9,570,058 B2
(45) Date of Patent: Feb. 14, 2017

(54) AUDIO SIGNAL PROCESSING DEVICE AND PARAMETER ADJUSTING METHOD

(71) Applicant: Yamaha Corporation, Hamamatsu-shi, Shizuoka-ken (JP)

(72) Inventor: Tatsuya Umeo, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 14/281,445

(22) Filed: May 19, 2014

(65) Prior Publication Data

US 2014/0254834 A1 Sep. 11, 2014

Related U.S. Application Data

(63) Continuation of application No. PCT/JP2012/079995, filed on Nov. 19, 2012.

(30) Foreign Application Priority Data

Nov. 19, 2011 (JP) ..... 2011-253370

(51) Int. Cl.

| | |
|---|---|
| ***G10H 1/32*** | (2006.01) |
| ***H04H 60/04*** | (2008.01) |
| ***H04R 5/04*** | (2006.01) |
| ***H04R 3/04*** | (2006.01) |

(52) U.S. Cl.

CPC ..... *G10H 1/32* (2013.01); *H04H 60/04* (2013.01); *H04R 5/04* (2013.01);

(Continued)

(58) Field of Classification Search

None

See application file for complete search history.

(56) References Cited

U.S. PATENT DOCUMENTS 5,801,699 A * 9/1998 Hocker ..... G06F 3/04817 715/781

2006/0222189 A1 10/2006 Terada (Continued)

FOREIGN PATENT DOCUMENTS

CN 1841494 A 10/2006

JP 7-015257 A 1/1995

(Continued)

OTHER PUBLICATIONS

Adobe Audition 3.0 User Guide (2007). Adobe Systems Incorporated.*

(Continued)

*Primary Examiner* — Curtis Kuntz

*Assistant Examiner* — Kenny Truong

(74) *Attorney, Agent, or Firm* — Morrison & Foerster LLP

(57) ABSTRACT

An audio signal processing device and a parameter adjusting method, configured such that: a two-channel screen displaying a plurality of parameters for each of two channels allocated to any two channel strips, in accordance with operation of edit buttons of the two channel strips, is displayed on a display; each of a plurality of parameters for one channel, out of the two channels displayed in the two-channel screen, are allocated to a control of each channel strip in a first group; each of a plurality of parameters for the other channel are allocated to a control of each channel strip in a second group; and values of the parameters allocated to the controls are adjusted in accordance with operation of the controls.

10 Claims, 7 Drawing Sheets

(52) U.S. Cl.
CPC ..... *G10H 2220/116* (2013.01); *H04R 3/04* (2013.01); *H04R 2430/01* (2013.01); *H04R 2430/03* (2013.01)

(56) References Cited

U.S. PATENT DOCUMENTS

| | | | |
|---|---|---|---|
| 2006/0232586 | A1 | 10/2006 | Terada |
| 2011/0058691 | A1 | 3/2011 | Okabayashi |

FOREIGN PATENT DOCUMENTS

| | | | |
|---|---|---|---|
| JP | 2006-254292 | A | 9/2006 |
| JP | 2006-311513 | A | 11/2006 |
| JP | 4210951 | B2 | 1/2009 |
| JP | 2011-055431 | A | 3/2011 |
| JP | 2011-199609 | A | 10/2011 |
| WO | WO-2013/073703 | A1 | 5/2013 |

OTHER PUBLICATIONS

Extended European Search Report mailed Apr. 8, 2015, for EP Application No. EP 12850169.9, ten pages.
Written Opinion of the International Searching Authority of the PCT Application No. PCT/JP2012/079995, mailed Feb. 12, 2013, English translation, eight pages.
Fujimoto, K., et al. (Jul. 31, 2004). "Cubase SX/SL for Windows2000/XP, Complete Operation Guide," Steinberg, Rittor Music, Inc., eight pages. (Re-submit).
International Search Report mailed Feb. 12, 2013, for PCT Application No. PCT/JP2012/079995, with English translation, 9 pages.
Steinberg. (Jul. 31, 2004). "Cubase SX/SL for Windows2000/XP, Complete Operation Guide," Rittor Music, Inc., eight pages.
Notification of the Second Office Action dated Sep. 19, 2016, for CN Application No. 201280056771.1, with English translation, 21 pages.

* cited by examiner

HARDWARE CONFIGURATION OF DIGITAL MIXER OF EMBODIMENT

EXTERNAL APPEARANCE DIAGRAM ILLUSTRATING DIGITAL MIXER AND EXTERNAL DISPLAY

DIAGRAM OF DETAILED FUNCTIONAL CONFIGURATION OF RESPECTIVE INPUT CHANNELS

DISPLAY EXAMPLE OF ONE-CHANNEL SCREEN

DISPLAY EXAMPLE OF TWO-CHANNEL SCREEN

Fig. 8

MODE TRANISTION OF SCREEN

| BEFORE \ AFTER | TO CHANNEL STRIP MODE | TO ONE-CHANNEL MODE | TO TWO-CHANNEL MODE |
|---|---|---|---|
| FROM CHANNEL STRIP MODE | - | DEPRESS EDIT BUTTON OF ARBITRARY ONE CHANNEL | SIMULTANEOUSLY DEPRESS EDIT BUTTONS OF ARBITRARY TWO CHANNELS |
| FROM ONE-CHANNEL MODE | DEPRESS EDIT BUTTON OF BEING-EDITED CHANNEL | (CHANNEL CHANGE) ↓ | SIMULTANEOUSLY DEPRESS EDIT BUTTONS OF ARBITRARY TWO CHANNELS |
| FROM TWO-CHANNEL MODE | DEPRESS EDIT BUTTON OF BEING-EDITED CHANNEL | DEPRESS EDIT BUTTON OF ONE NOT-BEING-EDITED CHANNEL | ↑ (CHANNEL CHANGE) |

Fig. 9A

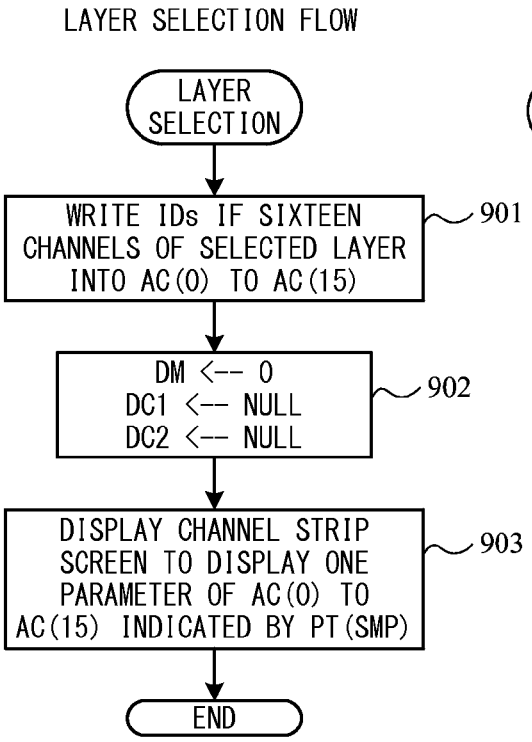

Fig. 9B

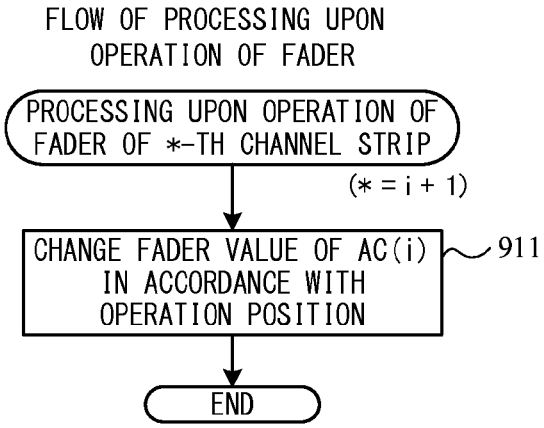

FLOW OF PROCESSING UPON OPERATION OF KNOB

ILLUSTRATION OF EXTERNAL APPEARANCE OF DIGITAL MIXER AND EXTERNAL DISPLAY

AUDIO SIGNAL PROCESSING DEVICE AND PARAMETER ADJUSTING METHOD

CROSS-REFERENCE TO RELATED APPLICATIONS

This application is a continuation of International Application No. PCT/JP2012/079995, filed Nov. 19, 2012, which claims the priority benefit of Japanese Patent Application No. 2011-253370 filed Nov. 19, 2011, the contents of which are hereby incorporated by reference in their entireties for all intended purposes.

TECHNICAL FIELD

The invention relates to an audio signal processing device and a parameter adjusting method, and more particularly, to a technique for opening a two-channel parameter edit screen with a simple operation.

BACKGROUND ART

An audio signal processing device such as a digital mixer has many channels to process audio signals of many sequences. Further, as a screen for display and setting of various parameters for these channels, a channel strip screen is provided (e.g., PTL1, FIG. 6 and paragraphs 0029 to 0036, or the like). The channel strip screen is a screen to display a list of parameter setting statuses for a predetermined number of channels (e.g., 8 channels or 16 channels). Further, by performing a predetermined operation from a status where the channel strip screen is displayed, a window for detailed editing of the parameter of each constituent block (equalizer, dynamics or the like) for one input channel is pop-up displayed (e.g., PTL1, FIG. 9 to FIG. 11).

On the other hand, conventionally, a so-called digital audio workstation (DAW) to realize various music production functions (e.g., a hard disk recording function, a function for generating and editing MIDI data or audio data, a mixing function and a sequencer function) is known (see NPL1). The DAW is realized by installing predetermined software program into, for example, a general-purpose personal computer (PC) and executing the program. The DAW is also provided with a channel strip screen to display parameters for plural channels. Further, when an edit button of the channel strip of any one channel displayed on the channel strip screen is operated, a parameter edit window to edit the parameters of the channel allocated to the channel strip in detail is opened.

CITATION LIST

Patent Literature

{PTL1} JP 4210951 B2
{NPL1} "Cubase SX/SL Complete Operation Guide", Rittor Music, Inc., Jul. 31, 2004

SUMMARY OF INVENTION

Technical Problem

In the above-described pop-up displayed window in the PTL1 and the parameter edit window in the NPL1, parameters for one channel can be operated. However, it is conceivable that operations are to be performed while comparing parameters for two channels to keep balance between the channels.

On the other hand, in an audio signal processing device such as a digital mixer, as described above, pop-up display of a window related to one channel is known. However, in this way, it is necessary for an operator to perform an operation while changing windows of channels to be compared, and the operation is complicated.

Further, in some DAWs, it is possible to simultaneously display an unlimited number of parameter edit windows for arbitrary channels. However, since it is too generic, it is necessary for an operator to arrange the respective parameter edit windows for the plural channels for easy viewableness using a mouse and operate them, and the operation is complicated. Accordingly, there are demands for switching between a channel strip screen to display a parameter setting status for plural channels, an arbitrary one-channel parameter edit screen and an arbitrary two-channel parameter edit screen, with a more simple operation.

The invention has an object to enable to open and switch a two-channel parameter edit screen with a simple operation in an audio signal processing device.

Solution to Problem

To attain the above object, an audio signal processing device according to the invention is one including: a channel processor having a plurality of channels each of which performs signal processing on an audio signal based on a value of a parameter by channel; a channel strip module having a plurality of channel strips, one channel strip having controls including at least one setting control and one edit button, and the plurality of channel strips being divided into a first group and a second group; a channel parameter adjustor that allocates any of the channels of the channel processor to the respective channel strips of the channel strip module, and adjusts, in accordance with an operation of a control other than the setting control and the edit button of the channel strip, a value of a parameter of a channel allocated to the channel strip; a first display controller for, in accordance with operations of the edit buttons of any two channel strips, controlling a predetermined display to display a two-channel screen to display respective pluralities of parameters of two channels allocated to the two channel strips; and a first parameter adjustor for allocating each of a plurality of parameters of one channel of the two channels displayed on the two-channel screen to the setting controls of the respective channel strips of the first group of the channel strip module, allocating each of a plurality of parameters of another channel of the two channels displayed on the two-channel screen to the setting controls of the respective channel strips of the second group of the channel strip module, and adjusting values of the parameters allocated to the respective setting controls in accordance with operations on the respective setting controls.

In such an audio signal processing device, it is conceivable that the device further includes: a second display controller that, when the two-channel screen is displayed on the display, in accordance with an operation of the edit button of one of the two channel strips to which the two channels displayed on the two-channel screen are allocated, controls the display to display a channel strip screen to display a list of setting statuses of parameters for all the channels allocated to the plurality of channel strips of the channel strip module; and a second parameter adjustor that, when the channel strip screen is displayed, in accordance with channel allocation by the channel parameter adjustor, allocates one parameter of some channel of the channel processor to the setting controls of the respective channel strips of the channel strip module, and adjust values of the parameters allocated to the respective setting controls in accordance with operations of the respective setting controls.

Further, it is also conceivable that the device further includes: a third display controller that, when the two-channel screen is displayed on the display, in accordance with an operation of the edit button of any one channel strip other than the two channel strips to which the two channels displayed on the two-channel screen are allocated, controls the display to display a one-channel screen to display a plurality of parameters of one channel allocated to the one channel strip; and a third parameter adjustor that allocates each of a plurality of parameters for the one channel displayed on the one-channel screen to the setting controls of the respective channel strips of the channel strip module, and adjusts values of the parameters allocated to the respective setting controls in accordance with operations of the respective setting controls.

Further, it is also conceivable that m and n are respectively an integer of 2 or greater, and the channel strip module includes a first channel strip section having m channel strips of the first group and a second channel strip section having n channel strips of the second group, when the two-channel screen is displayed on the display, the first parameter adjustor allocates m parameters for the one channel of the two channels displayed on the two-channel screen to the setting controls of the respective channel strips of the first channel strip section, and allocates n parameters of the another channel to the setting controls of the respective channel strips of the second channel strip section, and when the one-channel screen is displayed on the display, the third parameter adjustor allocates m+n parameters of the one channel displayed on the one-channel screen to the setting controls of the respective channel strips of the channel strip module.

Further, another audio signal processing device according to the invention is one for processing audio signals in a plurality of channels, including: a plurality of channel strips respectively having a selection control and a setting control, to each of which one of the channels can be allocated; a selector that, in accordance with an operation of the selection control of one or a plurality of channel strips, selects one or a plurality of channels allocated to the one or the plurality of channel strips; and a first parameter adjustor that allocates respective pluralities of parameters of the one or the plurality of channels selected by the selector to the setting controls of the plurality of channel strips, respectively, and adjusts values of the parameters allocated to the respective setting controls in accordance with operations of the respective setting controls, wherein the channels selected by the selector in accordance with the operation of the respective selection controls are not changed before and after parameter allocation by the first parameter adjustor.

In such an audio signal processing device, it is conceivable that the device further includes: a releasing device that releases channel selection by the selector; and a second parameter adjustor that, when the channel selection is released by the releasing device, allocating parameters of the channels allocated to the channel strips to the setting controls of the respective channel strips, respectively, and in accordance with operations of the respective setting controls, adjusts values of the parameters allocated to the respective setting controls.

Further, it is also conceivable that M is an integer of 1 or greater, N is an integer of 2 or greater, and N>M holds, N channel strips are provided, and wherein when the selector selects M channels, the first parameter adjustor divides the N channel strips into M groups and respectively sets correspondence between the M channels and the groups, and regarding the respective groups, allocates, to the selection controls of respective channel strips belonging to the group, as many parameters of a channel corresponding to the group as number of the selection controls.

Further, it is also conceivable that the device further includes a display controller that, in accordance with number of channels to which the first parameter adjustor has allocated the parameters, displays information related to the respective channels on a predetermined display.

Further, it is also conceivable that the display controller has a device that displays, in a screen displayed on the display, information related to a parameter allocated to the setting control, in a position corresponding to the respective setting controls in an array direction of the channel strips.

Further, the invention can be implemented in an arbitrary form such as methods, systems, programs, computer-readable media, and so on other than the above described devices.

Advantageous Effects of Invention

According to the invention, it is possible to open a two-channel screen for desired two channels as control objects and to edit the parameters for the channels, with a simple operation of an edit button prepared in each channel strip. In this two-channel screen, it is possible to adjust values of the parameters for arbitrary two channels while comparing them with each other.

BRIEF DESCRIPTION OF DRAWINGS

FIG. 8 is a diagram illustrating mode transition of a screen.

FIG. 9A is a flowchart of layer selection processing.

FIG. 9B is a flowchart of fader in-operation processing.

DESCRIPTION OF EMBODIMENTS

Hereinbelow, an embodiment of the invention will be described using the drawings.

Figure 1:
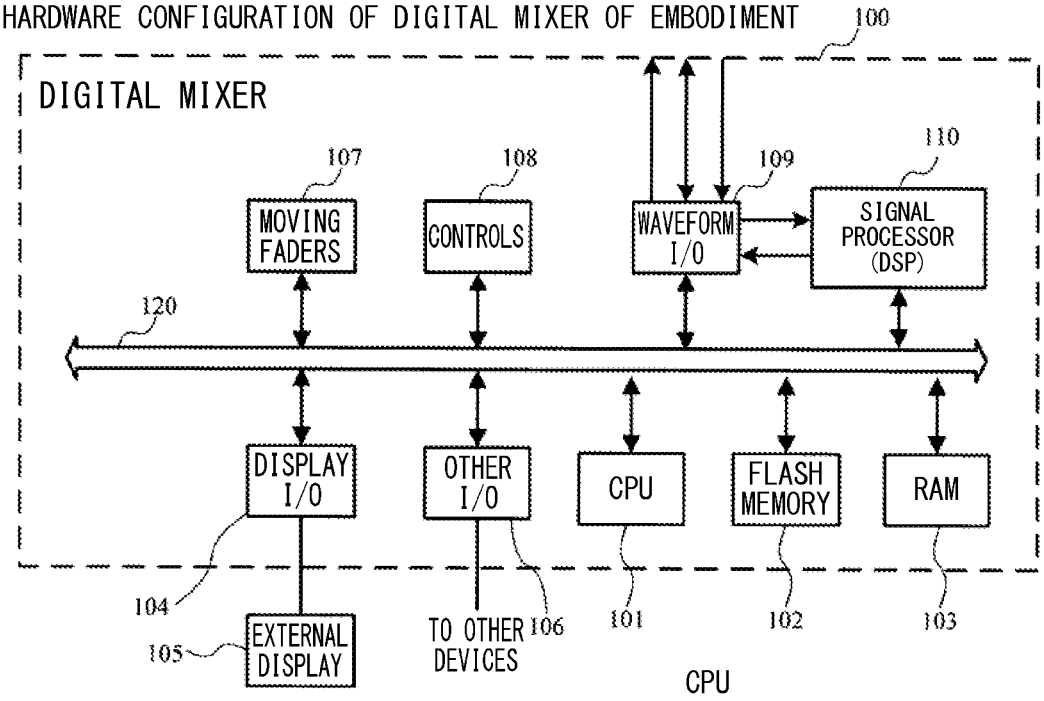
FIG. 1 is a block diagram illustrating a hardware configuration of a digital mixer as an audio signal processing device according to an embodiment of the invention.

FIG. 1 is a block diagram illustrating a hardware configuration of a digital mixer (hereinbelow, simply referred to as a "mixer") 100 as an audio signal processing device according to an embodiment of the invention.

A central processing unit (CPU) 101 is a processing unit to control operation of the entire mixer.

A flash memory 102 is a nonvolatile memory mainly storing various programs executed by the CPU 101, various data and so on. A random access memory (RAM) 103 is a volatile memory mainly used as a load area for the programs executed by the CPU 101 and a work area.

A display input/output interface (I/O) 104 is an interface for connection with an external display unit (display) 105.

An other I/O 106 is an interface for connection with other various devices.

Moving faders 107 are controls to set various parameter values provided on an operation panel.

Controls 108 are various controls (buttons and the like other than the moving faders) for a user's operation provided on the operation panel.

A waveform I/O 109 is an interface for transmitting and receiving an audio signal to/from an external device.

A signal processor (DSP) 110 performs mixing processing, effect processing, volume level control processing or the like on an audio signal inputted via the waveform I/O 109 by executing various micro programs based on a command from the CPU 101, and outputs the processed audio signal via the waveform I/O 109. Note that it may be arranged such that all or a part of the signal processing performed by the DSP 110 is performed with software executed on the CPU 101.

A bus 120 is a bus line connecting these respective elements. It is a generic name of a control bus, a data bus and an address bus.

Among these elements, any of the CPU 101, the display I/O 104 and the display 105, and the controls 108 are essential constituent elements of the audio signal processing device of the invention. The other constituent elements may be omitted in accordance with necessity or a structure where they are provided in another device may be used.

Figure 2:
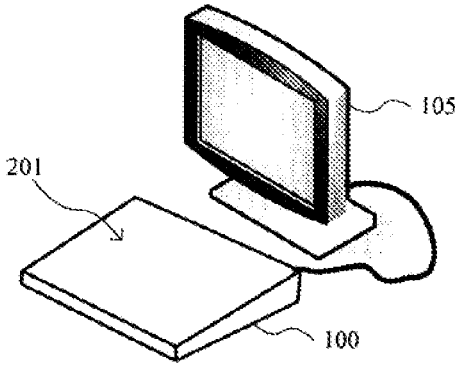
FIG. 2 is an external appearance diagram illustrating a status where the digital mixer and an external display device are connected.

FIG. 2 is an external appearance diagram illustrating a status where the mixer 100 and the display 105 in FIG. 1 are connected. The moving faders 107, the controls 108 and the like are arranged on an operation panel 201 in a top surface of the mixer 100, although they are not shown. As the display 105, an arbitrary-sized display is connectable.

Figure 3:
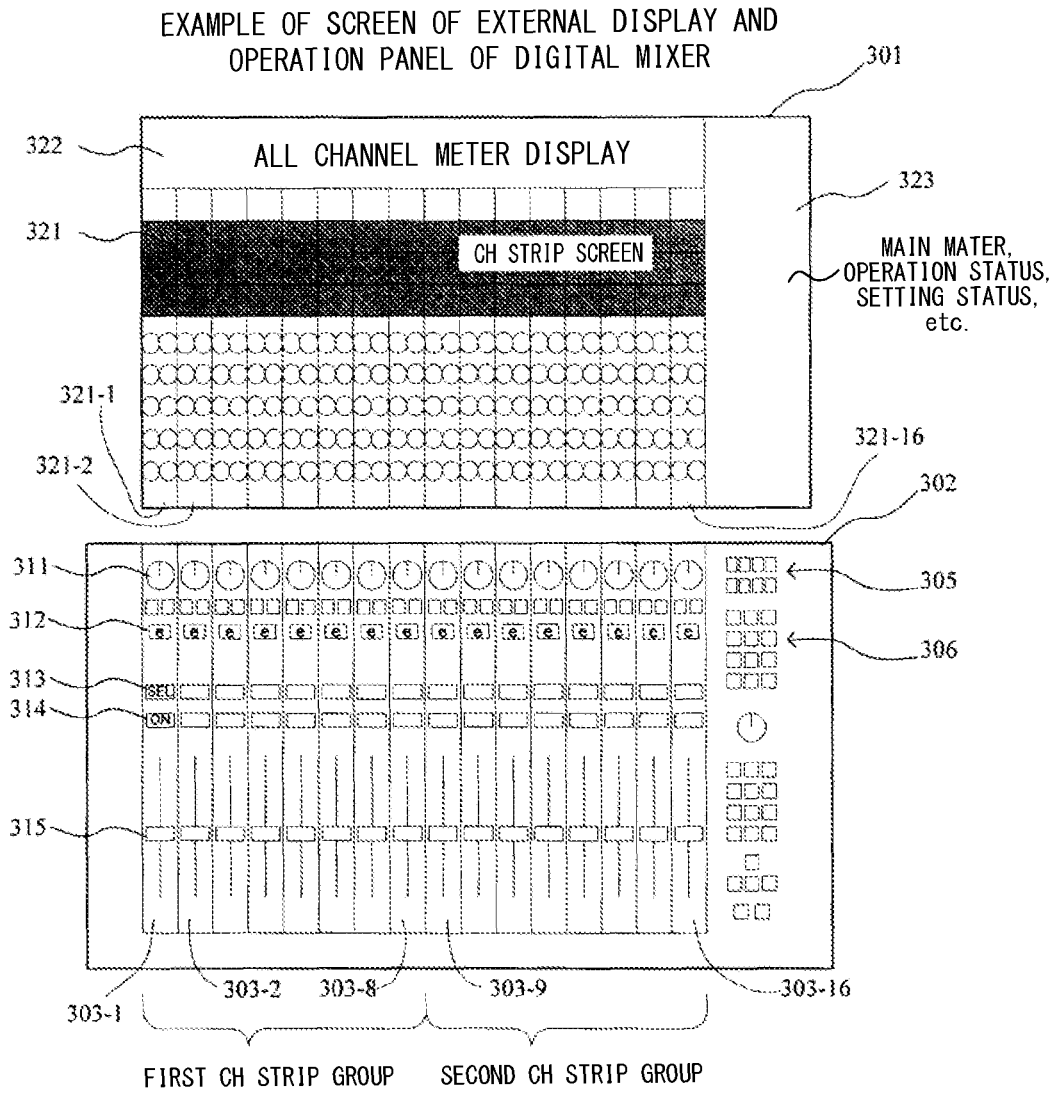
FIG. 3 is a diagram illustrating an example of a screen displayed on the external display device and an arrangement on an operation panel of the digital mixer.

Note that as shown in FIG. 3 described later, to perform a display corresponding to the number of channel strips provided on the operation panel 201, it is preferable that a display having a certain size (preferably having a width approximately corresponding to that of the operation panel 201 or a channel strip module described later) is connected. Further, as shown in FIG. 3, it is preferable that the display 105 is arranged such that the respective channel strips on the operation panel 201 are positioned on lower side of respective channel strips displayed on a channel strip screen.

FIG. 3 illustrates an example of a screen displayed on the display 105 and an arrangement on the operation panel 201 of the mixer 100 in the present embodiment. Numeral 301 denotes a screen example displayed on the display 105; and numeral 302 denotes an outer appearance of the various controls arranged on the operation panel 201.

A channel strip module including sixteen channel strips 303-1 to 303-16 is provided on the operation panel. The left eight strips will be referred to as a first channel strip group; and the right eight strips will be referred to as a second channel strip group. One channel strip, e.g., the channel strip 303-1 has respective controls of a rotary encoder (knob) 311, an edit button 312, a SEL button 313, an ON button 314, and a moving fader 315.

The knob 311 is a setting control and it is a rotary encoder for parameter adjustment the function of which is changed in correspondence with information or the like displayed on the upper side screen 301.

The edit button 312 is a selection control and it is a button used when displaying a one-channel screen or two-channel screen which is described later in detail.

The SEL button 313 is a button used when selecting a channel allocated to the channel strip 303-1.

The ON button 314 is a button to turn on/off signal passage through the channel allocated to the channel strip 303-1.

The moving fader 315 is a slide control to adjust a volume level (signal level) or the like of the allocated channel. It is not necessary that the slide control is electrically driven.

The other channel strips 303-2 to 303-16 have the same structure. Note that constituent elements 311 to 315 of each channel strip have branch numbers 1 to 16. For example, the knob of the channel strip 303-3 is denoted by numeral 311-3.

Numeral 305 denotes a button group to move a pointer of a parameter table PT (from another point of view, a parameter page designation button group), and numeral 306 denotes a button group to designate a parameter type (genre) to be displayed. These groups will be described later in detail.

In the screen example 301, numeral 321 denotes a channel strip screen (whole), numeral 322 denotes an all channel meter display screen, and numeral 323 denotes a main meter and the like display screen.

The channel strip screen 321 is a screen where channel parameter display regions 321-1 to 321-16 corresponding to the channel strips 303-1 to 303-16 are arrayed. In one channel parameter display region, e.g. 321-1, setting statuses of various parameters related to a channel allocated to the corresponding channel strip 303-1 are displayed.

Further, the respective channel strips 303-1 to 303-16 and the channel strip display regions 321-1 to 321-16 corresponding to the channel strips are arrayed in the same order in the array direction (lateral direction in the figure) of the channel strips. Accordingly, regarding all the channel strips 303, the channel strip display region 321 to display information related to the channel strip 303 is in a position corresponding to the channel strip 303 in the channel strip array direction. Note that when width of the channel strip 303 and width of the channel strip display region 321 are approximately the same, the channel strip 303 and the channel strip display region 321 corresponding to that channel strip 303 are aligned in the vertical direction in the figure, to produce an easily viewable display.

Further, in the channel strip screen 321, the mixer 100 highlight-displays a parameter assigned to the knob 311. The same display is performed in the other channel parameter display regions 321-2 to 321-16.

The all channel meter display screen 322 is a screen to display meters indicating signal levels of all the respective channels.

The main meter and the like display screen 323 is a screen to display meters indicating level of a primary signal such as a main output signal from a main mixer and various information indicating operation status or setting status and the like of the mixer.

Figure 4:
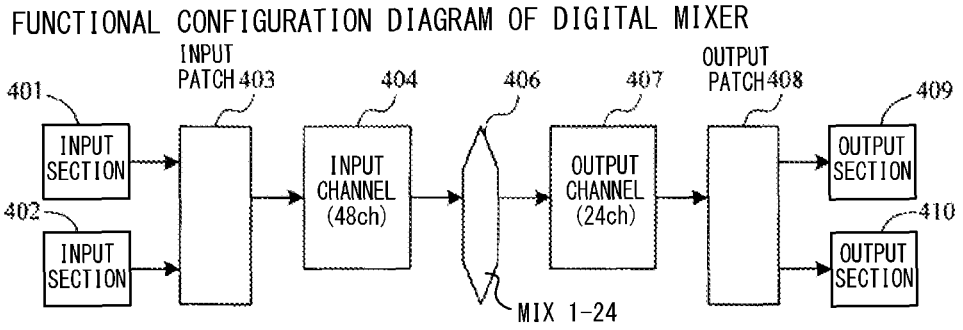
FIG. 4 is a block diagram illustrating a functional configuration of mixing processing.

FIG. 4 is a block diagram illustrating a functional configuration of mixing processing executed by the mixer 100.

An input section 401 converts an analog audio signal inputted from a microphone or the like into a digital signal and inputs it. An input section 402 inputs a digital audio signal. It is possible to provide a plurality of these input sections (there is an upper limit of the number corresponding to the device configuration), respectively.

An input patch 403 performs wiring to connect the signal inputted from the input section 401 or the input section 402 to an arbitrary input channel of the input channel section 404. The user can arbitrarily perform setting of the wiring while watching a predetermined screen.

In the present embodiment, the input channel section 404 is provided with forty-eight input channels. Each input channel performs various signal processing such as level control and frequency characteristic adjustment processing on an input signal based on parameter values set so as to be reflected in the current signal processing. It is possible to output the signal from each input channel to each MIX bus of an MIX bus section 406, and independently set its transmission level.

The MIX bus section 406 has twenty-four MIX buses. The respective twenty-four MIX buses mix signals inputted from the respective input channels of the input channel section 404. The respective MIX buses output the mixing-processed signals to output channels corresponding to the MIX buses in an output channel section 407.

The respective MIX buses of the MIX bus section 406 and the respective output channels of the output channel section 407 are corresponded in one-to-one manner. In the present embodiment, the output channel section 407 is provided with twenty-four output channels. The respective output channels perform various signal processing on the output side based on values of parameters set to be reflected in the current signal processing.

The output channels respectively output the processed signal to the output patch 408. The output patch 408 performs wiring from the respective output channels of the output channel section 407 to an arbitrary output section 409 or output section 410. The user can arbitrarily set the wiring while watching a predetermined screen.

The output section 409 converts a digital signal inputted from the output patch 408 into an analog audio signal and outputs it to a connected amplifier or the like. The output section 410 outputs a digital signal inputted from the output patch 408 to connected another device. It is possible to provide a plurality of (there is an upper limit of the numbers in correspondence with the device structure) these output sections, respectively.

Note that the input sections 401 and 402 and the output sections 409 and 410 are realized with the waveform I/O 109 in FIG. 1. The other elements 403 to 408 are realized by execution of a predetermined micro program by the DSP 110. The CPU 101 sends the micro program to the DSP 110 to set the micro program in the DSP 110, and the CPU 101 also sends coefficient data to be used when the DSP executes the micro program, to the DSP 110 to set the coefficient data in the DSP 110. However, it may be configured such that the DSP 110 performs setting of the micro program and the coefficient data independently of the CPU 101, and still another configuration is also conceivable.

Figure 5:
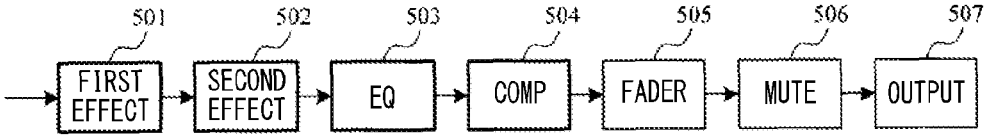
FIG. 5 is a block diagram illustrating a functional configuration of one channel in an input channel section.

FIG. 5 is a block diagram illustrating a functional configuration of one channel in the input channel section 404 described in FIG. 4.

A digital signal is inputted from the input patch 403 to the input channel. A first effect (501) and a second effect (502) are effects which the user can arbitrarily select and allocate from internal effects previously prepared in the mixer 100. Effect data of a selected internal effect is sent to the DSP 110, and the first and second effects are realized through operation of DSP 110 based on the effect data.

An EQ 503 is an equalizer to perform frequency characteristic adjustment processing.

A Comp 504 is a compressor to perform automatic gain adjustment processing.

A fader 505 adjusts a signal level or the like according to setting position of the moving fader 107 (315 in FIG. 3).

A mute 506 is an element to perform mute according to setting status of the ON button 314.

An output 507 performs adjustment of transmission level, for respective buses, upon output of a signal of the input channel to the respective MIX buses of the MIX bus section 406. In the above description, the input channel is described; however, the functional configuration of the output channel is the same except that the output 507 outputs a signal only to the output patch 408, and the transmission level adjustment is not performed there. Further, this functional configuration is merely an example, and it may be arbitrarily changed in correspondence with device configuration, purpose, use or the like.

The respective elements in the above-described FIG. 4 and FIG. 5 have various parameters necessary for signal processing in the respective elements. The mixer 100 stores values of these parameters in a parameter region for storage of parameter values to be reflected in current various operations, provided in a flash memory 102 or the RAM 103.

The mixer 100 performs settings of signal processing in the respective elements and setting of panel status based on values of the parameters stored in the parameter region. That is, the user can control the operations of the respective elements of the mixer 100 by setting and changing values of the various parameters on the parameter region.

The mixer 100 changes (adjusts) values of the parameters stored in the above-described parameter region in correspondence with various operations performed by the user with the controls 107 and 108, the display 105 and the like. Further, the respective parameters, parameter values of which are stored in the above-described parameter region, respectively have a unique ID not depending on the channels. That is, the parameters corresponding to the respective input channels and output channels basically have the same data structure (array), and it is possible to specify the same parameter (e.g. signal level gain) for different two channels by the same ID. Note that various formats such as a numeric value, a bit value, a character string and the like may be employed as format of the parameter ID.

Figure 6:
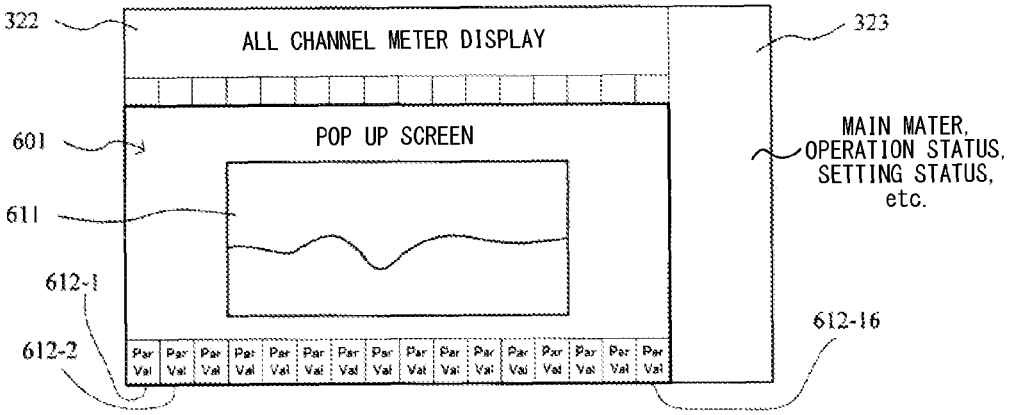
FIG. 6 is a diagram illustrating a display example of a one-channel screen.

FIG. 6 illustrates a display example of a one-channel screen.

When the mixer 100 detects depression of the edit button 312 of any one channel strip 303 which is not being edited, the mixer 100 displays a one-channel screen related to a channel allocated to the channel strip. A one-channel screen 601 is pop-up displayed in the region where the channel strip screen 321 has been displayed. The display contents in the channel strip screen 321 are continuously displayed on the all channel meter display screen 322 on the upper side and the main meter or the like display screen 323 on the right side.

Note that "being edited" means a status where parameter change is performed utilizing the one-channel screen 601 displayed in correspondence with depression of the edit button 312 (or two-channel screens 701 and 702 described later).

The one-channel screen is a screen to display and edit a designated type of parameter for designated one channel. As described above, the channel as an editing object is a channel allocated to one channel strip having the depressed edit button 312.

The parameter type (genre) as an editing object is designated using the button group 306 in FIG. 3. More particularly, in the present embodiment, the button group 306 is a button group to select any one of (1) routing, (2) pan, (3) send, (4) equalizer, (5) compressor, (6) first effect and (7) second effect.

In the button group 306, any one button is always in an on status (a status where the parameter type corresponding to the button is designated). Then when an off status button of the button group 306 is depressed, the on status button turns into the off status, the depressed button turns into the on status, and the mixer 100 turns into a status where the genre corresponding to the depressed button is designated.

The one-channel screen 601 in FIG. 6 is an example where a button to designate the (4) equalizer is in the on status in the above-described button group 306.

Numeral 611 denotes a graph showing a current setting status of the equalizer in the relevant channel, in which a horizontal axis indicates a frequency and a vertical axis indicates an attenuation level of respective frequencies.

Numerals 612-1 to 612-16 denote display regions for a parameter name "Par" and its set value "Val" of respective frequency bands (bands).

For example, in the case of a thirty-one band equalizer, in the display region 612-1, as a name of the first band parameter "Par", frequency "20 Hz" is displayed, and as its set value "Val", a level value (e.g., "−12.5 dB", "3 dB", "0 dB", . . . ) is displayed. In the display region 612-2, as a name of the second band parameter "Par", frequency "25 Hz" is displayed, and as its set value "Val", a level value is displayed. In the display region 612-3, as a name of the third band parameter "Par", frequency "31.5 Hz" is displayed, and as its set value "Val", a level value is displayed. Hereinbelow, similar displays are made.

These display regions 612-1 to 612-16 respectively correspond sequentially to the knobs 311-1 to 311-16 of the operation panel. It is possible to adjust level value of the first band with the knob 311-1; level value of the second band, with the knob 311-2; . . . , respectively. In particular, the user can operate the knob 311 while watching a parameter name to change the corresponding parameter value.

That is, in the respective display regions 612-1 to 612-16, information related to a parameter operative with the knob 311 corresponding to the display region 612 is displayed.

Further, the respective display regions 612-1 to 612-16 and the knobs 311 or channel strips 303 corresponding to the display regions are arranged in the same order in the channel strip array direction (lateral direction in the figure). Accordingly, regarding all the knobs 311, the display region 612 to display information related to a parameter operative with the knob 311 is in a position corresponding to the knob 311 in the channel strip array direction. This point is the same as the correspondence between the channel strip 303 and the channel strip display region 321.

The example in FIG. 6 is a thirty-one band equalizer. As the number of channel strips 303 is sixteen, in the initial display status of the one-channel screen 601, the mixer 100 sequentially displays the respective level values of the first to sixteenth bands in the display regions 612-1 to 612-16. The user can adjust these respective level values with the respective knobs 311-1 to 311-16.

Level values of the seventeenth to thirty-first bands are displayed by designating next page with the button group 305. The button group 305 is a button group to designate a page such as first page, second page, . . . . In the initial display status of the one-channel screen 601, the first page is designated, and when a button to designate another page is depressed, the display of the one-channel screen 601 is changed to the page.

Accordingly, when the user depresses a second page designation button while the one-channel screen 601 is displayed, the parameter name and level value of the seventeenth band are displayed in the display region 612-1; the parameter name and level value of the eighteenth band in the display region 612-2; . . . , in this manner, parameter names and level values of the respective bands of the second page are displayed. Then the user can adjust level value of the seventeenth band with the knob 311-1; level value of the eighteenth band with the knob 311-2; . . . , in this manner, the user can respectively adjust level values of the seventeenth to thirty-first bands with the knobs 311. Note that in this example, since there are 31 bands, when the second page is displayed, nothing is displayed in the display region 612-16, and the operation of the knob 311-16 is invalid.

Note that when the one-channel screen 601 is displayed, although the functions of the respective knobs 311 are changed in correspondence with parameter type displayed on the one-channel screen 601 as described above, the functions of the other controls 312 to 315 of the channel strip 303 are not changed. For example, it is possible to adjust level of a channel allocated to the channel strip 303-1 by operating the fader 315-1.

Here the example of thirty-one-band equalizer is described, however, when another genre is selected with the button group 306, a similar operation is performed.

For example, when the user depresses the edit button 312 of any one channel strip 303 in a status where (3) send is selected, the mixer 100 displays a one-channel screen to adjust the send level from the channel allocated to the relevant channel strip 303 to respective destinations (output destinations).

First displayed are the send levels to sixteen destinations of the first page. That is, in the display regions 612-1 to 612-16 in FIG. 6, as the name "Par", names of destination bus (e.g. "MIX1", "MIX2", "MIX3", . . . ) are sequentially displayed, and as the set value "Val", send level values to the respective destinations (e.g., "−∞dB", "−6 dB", "−20 dB", . . . ) are displayed.

The user can adjust the send levels to the respective destinations by operating the knobs 311 while watching the respective destinations. Further, the user can adjust send levels to the output destinations in the second and the subsequent pages by switching to the second and subsequent pages with the button group 305. Note that in the case of send level, it is preferably configured such that, send on parameters to corresponding destination buses can be turned on and off (i.e., signal supply and not supply to the bus is controlled), by utilizing a button provided in the vicinity of the respective knobs 311.

Note that when the (6) first effect is selected with the button group 306, a one-channel screen 601 to display and edit plural parameters related to effect processing allocated to the first effect (501) in FIG. 5 at that time is displayed, and it is possible to adjust these parameter values with the knobs 311. When the (7) second effect is selected, a one-channel screen 601 to display and edit plural parameters related to effect processing allocated to the second effect (502) in FIG. 5 at that time is displayed, and it is possible to adjust those parameter values with the knobs 311.

Figure 7:
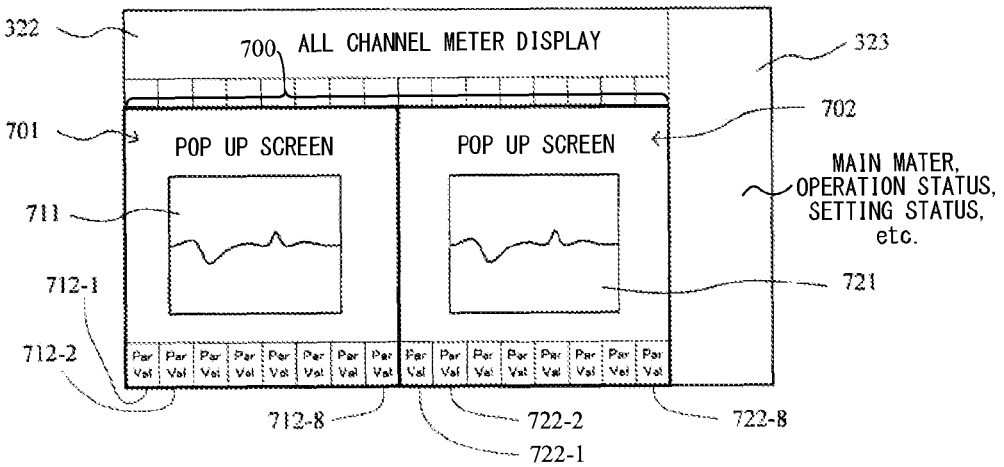
FIG. 7 is a diagram illustrating a display example of a two-channel screen.

FIG. 7 illustrates a display example of a two-channel screen.

When the user simultaneously depresses the edit buttons 312 of any two channel strips 303, the mixer 100 displays a two-channel screen related to two channels allocated to those channel strips. The two-channel screen has a left screen 701 and a right screen 702. The two-channel screens 701 and 702 are pop-up displayed in the region where the channel strip screen 321 has been displayed. The display contents in the channel strip screen 321 are continuously displayed on the all channel meter display screen 322 on the upper side and the main meter or the like display screen 323 on the right side.

The two-channel screen is a screen to simultaneously display and edit designated type of parameters for designated two channels while comparing them with each other. The editing object channels are two channels allocated to the two channel strips having the simultaneously depressed edit buttons 312 as described above. The two channels are arbitrarily allocated to the left screen 701 and the right screen 702. However, the channel having a smaller channel number is allocated to the left screen while the other is allocated to the right screen here. As in the case of the one-channel screen, the designation of the parameter type as the editing object is made with the button group 306 in FIG. 3.

The two-channel screen 700 in FIG. 7 is a screen example where a button to designate the (4) equalizer among the above-described button group 306 is in the on status. As it is understood from the figure, the structures of the left screen 701 and the right screen 702 of the two-channel screen 700 are the same as those in the one-channel screen 601 in FIG. 6.

As in the case of FIG. 6, the name "Par" and the set value "Val" are displayed in respective display regions 712-1 to 712-8 in the left screen 701 and display regions 722-1 to 722-8 in the right screen 702.

The correspondence between the respective display regions 712 and the knobs 311 or the channel strips 303 is also the same as that in the case of the display regions 612 in the one-channel screen 601.

Note that the number of parameters to be displayed and edited is respectively eight in the left screen 701 and the right screen 702 of the two-channel screen whereas that is sixteen in the one-channel screen 601. Accordingly, in the initial display status of the two-channel screen 700, it is possible to respectively adjust the first to eighth bands of the editing object channel in the left screen 701, with the knobs 311-1 to 311-8, and adjust the first to eighth bands of the editing object channel in the right screen 702 with the knobs 311-9 to 311-16. Regarding the ninth and subsequent bands, as in the case of the one-channel screen 601, a page is designated with the button group 305 and display and editing are performed according to the designation.

In this example, as the number of bands is thirty one, it is possible to adjust all the bands by switching the first to fourth pages. Note that the page displayed on the left screen 701 and the page displayed on the right screen 702 may be the same or may be different. Further, when a button to designate another genre is turned on in the button group 306, as in the case of the one-channel screen 601 in FIG. 6, the screen is changed to a screen to display and edit parameters of the another genre.

As in the case of the one-channel screen 601 in FIG. 6, when the two-channel screens 701 and 702 are displayed, the functions of the other controls 312 to 315 of the channel strip 303 are not changed.

FIG. 8 is a table showing mode transition of a screen in the mixer according to the present embodiment. The mode when the channel strip screen is displayed is referred to as a channel strip mode; when the one-channel screen is displayed, as a one-channel mode; and when the two-channel screen is displayed, as a two-channel mode. In FIG. 8, a "before" cell indicates a mode before a transition, and an "after" cell indicates a mode after the transition. In the table, an operation to cause the mode transition is shown.

In the status of the channel strip mode, when the edit button 312 of arbitrary one channel strip is depressed, the mixer 100 shifts to the one-channel mode to display a one-channel screen related to the channel allocated to the channel strip, and when the edit buttons 312 for arbitrary two channel strips are simultaneously depressed, shifts to the two-channel mode to display a two-channel screen related to two channels allocated to those channel strips.

Further, in the status of the one-channel mode, when the edit button 312 of a being-edited channel is depressed, the mixer 100 returns to the channel strip mode. In the status of the one-channel mode, when the edit button 312 of another channel than the being-edited channel is depressed, the editing object channel in the displayed one-channel screen is changed, although still in the one-channel mode, to the channel corresponding to the newly-depressed edit button 312. In the status of the one-channel mode, when arbitrary two edit buttons 312 are simultaneously depressed, the mixer 100 changes to the two-channel mode to display a two-channel screen related to those two channels.

Further, in the status of the two-channel mode, when the edit button 312 of any one of the being-edited two channels is depressed, the mixer 100 returns to the channel strip mode. In the status of the two-channel mode, when the edit button 312 of arbitrary not-being-edited one channel is depressed, the mixer 100 shifts to the one-channel mode to display a one-channel screen related to the channel. In the status of the two-channel mode, when the edit buttons 312 of arbitrary two channels are simultaneously depressed, the mixer 100 changes, although still in the two-channel mode, the editing object channel in the displayed two-channel screen to two channels corresponding to the newly-depressed edit buttons 312.

Note that in the status of the one-channel mode or the two-channel mode, when the genre is changed with the button group 306, the screen is changed to a one-channel screen or two-channel screen related to the newly designated genre. Here, the displayed page is initialized to the first page. For example, in a status where the second page is displayed in the one-channel screen of the equalizer, when the genre is changed to the compressor with the button group 306, the mixer 100 displays the first page of the one-channel screen of the compressor.

Note that it is not necessary to perform the above-described initialization to the first page. In this case, when there is no parameter to be displayed in the displayed page regarding a screen corresponding to the genre after the change, a blank page may be displayed.

Next, with reference to the flowcharts of FIG. 9A and FIG. 9B and the subsequent figures, operation of the mixer according to the present embodiment will be described. The flowcharts of FIG. 9A and FIG. 9B and the subsequent figures shows processing performed by the CPU 101 in accordance with a program stored in the flash memory 102.

Prior to the explanation of the flow, variables will be explained. Note that a sign indicating a variable represents its variable and also represents data stored in the variable.

AC (i): an array to store IDs of channels allocated to the sixteen channel strips 303-1 to 303-16. Each channel strip is specified with a suffix i (i is an integer from 0 to 15) sequentially from the left. For example, ID of a channel allocated to the channel strip 303-1 is stored in AC (0), and ID of a channel allocated to the channel strip 303-2 is stored in AC (1). Note that in the present embodiment, ID of a channel means information to uniquely identify each of forty-eight channels as input and twenty-four channels as output, i.e., information represented with a numerical value, a bit value, a character string or the like.

DM: DM indicates a display mode. When DM is 0, it indicates the channel strip mode; when DM is 1, the one-channel mode; and when DM is 2, the two-channel mode.

DC1 and DC2: DC1 and DC2 are variables to store ID(s) of the editing object channel(s) (display channel) of a screen displayed in the one-channel mode or the two-channel mode. In the channel strip mode, DC1 and DC2 are both null. In the one-channel mode, ID of the editing object channel of a one-channel screen is stored into DC1, and DC2 is null; in the two-channel mode, the ID of the editing object channel of the left screen of a two-channel screen is stored into DC1 and the ID of the editing object channel of the right screen is stored into DC2.

Note that in the mixer 100, the edit button 312 of the channel strip 303 to which ID of the channel stored as an editing object channel in the variable DC1 or DC2 is allocated is turned on, and the edit buttons 312 of the other channel strips 303 are turned off. With this configuration, the user can visually check which the edit button is the "edit button of being-edited channel", and efficiently perform an operation to "depress the edit button of being-edited channel" or the like in the table of FIG. 8.

PT: PT indicates a parameter table storing IDs of respective parameters of a currently-selected genre. It is an array provided by genre to be designated with the button group 306.

For example, as the parameters of the genre of the equalizer are thirty-one parameters of attenuation levels of the respective first to thirty-first bands, parameter IDs to specify those respective thirty-one parameters are sequentially set in the parameter table PT corresponding to the equalizer. That is, the parameter ID of "the attenuation level of the first band" is set in PT (0); the parameter ID of "the attenuation level of the second band", in PT (1); . . . ; and the parameter ID of "the attenuation level of the thirty-first band", in PT (30), respectively.

Note that actually, although a parameter table is prepared by genre, in the following description, the parameter tables will be described with only one sign PT. That is, simply referring to as a parameter PT means parameter table for a genre currently designated with the button group 306. Note that the parameter table PT may be a table which the user can edit, or may be different tables for respective modes.

SMP: SMP is a strip mode pointer. It is a variable used as a suffix of the parameter table PT. Value of the suffix to refer to ID of a parameter allocated to the knob 311 in the channel strip mode is stored in SMP. Conversely, in the channel strip mode, when the knob 311 of any channel strip 303 is operated, value of the parameter having the ID of PT(SMP) for the channel allocated to the channel strip 303 is adjusted in accordance with the knob operating amount.

In more detail, in the channel strip mode, although channels are allocated to the respective channel strips 303, the user can allocate an arbitrary parameter to be adjusted, to the knobs 311. For example, when first to sixteenth input channels are respectively allocated to the channel strips 303-1 to 303-16 and the third band of the equalizer is allocated to the knob 311 by the user's setting, it is possible to adjust the attenuation level of the third band of the equalizer of the first input channel with the knob 311-1; the third band of the equalizer of the second input channel with the knob 311-2; . . . .

Here, the parameter allocation to the knob 311 by the user means determination of value of SMP for internal reference to the relevant parameter ID through PT(SMP). In the above-described example, when the user performs setting to allocate the third band of the equalizer to the knob 311, the mixer 100 sets SMP at 2, and when PT(SMP) i.e. PT(2) is referred to from the parameter table PT of the equalizer, it is found that ID of the parameter allocated to the knobs 311 indicates the third band of the equalizer.

Note that initial value of SMP is 0 (parameter specified by a parameter ID described in the head of the array of the parameter table PT). It is possible to set any one of the parameters arrayed in the parameter table PT by incrementing (or decrementing) by 1 when the mixer 100 detects a predetermined operation.

1CMP: 1CMP is a one-channel mode pointer. It is a variable used as a suffix of the parameter table PT. Value of the suffix to refer to ID of the parameter allocated to the knob 311-1 of the leftmost channel strip 303-1 in the one-channel mode is stored in this variable. Conversely, in the one-channel mode, when the knob 311-* of the channel strip 303-* (* is an integer of i+1; i is an integer from 0 to 15) is operated, value of the parameter having the ID of PT(1CMP+i) of the editing object channel (i.e., DC1) of the currently displayed one-channel screen may be adjusted in correspondence with knob operation amount. In this embodiment, the initial value of 1CMP is 0, and when a page p is designated with the button group 305, 1CMP is set at $16\times(p-1)$. However, the setting is not limited to this example.

2CMP: 2CMP is a two-channel mode pointer. It is a variable used as a suffix of the parameter table PT. Value of a suffix to refer to ID of the parameter allocated to the knob 311-1 of the leftmost channel strip 303-1 in the two-channel mode is stored in this variable. Conversely, in the two-channel mode, when the knob 311-* of the channel strip 303-* (* is an integer of i+1; i is an integer from 0 to 15) and $0\leq i\leq 7$ holds, value of the parameter having the ID of PT(2CMP+i) for the editing object channel (i.e. DC1) in the left screen of the currently-displayed two-channel screen may be adjusted in accordance with knob operation amount. When $8\leq i\leq 15$ holds, value of the parameter having the ID of PT(2CMP+i−8) of the editing object channel (i.e. DC2) in the right screen of the currently-discharged two-channel screen may be adjusted in accordance with knob operation amount. In this embodiment, the initial value of 2CMP is 0. When a page p is designated with the button group 305, 2CMP is set at $8\times(p-1)$. However, the setting is not limited to this example.

SO: SO is a simultaneous operation flag. This flag is 0 when only one edit button is on, and is 1 when plural edit buttons are simultaneously on.

EB(i): EB(i) are edit button status flags. The initial status of these flags are EB(i)=0. When the edit button 312-* of the channel strip 303-* (* is an integer of i+1; i is an integer from 0 to 15) is operated to be ON, EB (i) is set at 1.

lsn and rsn: lsn and rsn are variables to store values indicating the channel strips 303 having simultaneously turned-on two edit buttons. As in the case of the above-described i, lsn and rsn are integers from 0 to 15. 0 indicates the channel strip 303-1, and 15 indicates the channel strip 303-16.

FIG. 9A is a flow showing a procedure of layer selection processing. The layer is a channel group allocated to the sixteen channel strips 303. As shown in FIG. 4, in the mixer according to the present embodiment, as forty-eight input channels and twenty-four output channels and the like are provided, e.g., a layer of the first to sixteenth input channels, a layer of the seventeenth to thirty-second input channels, . . . and the like, are provided. When the CPU 101 detects an operation to select these layers, it starts the processing in FIG. 9A.

In this processing, first at step 901, the CPU 101 writes the respective IDs of sixteen channels of the selected layer into AC(0) to AC(15).

Next, at step 902, the CPU 101 sets the display mode DM=0, and writes null into DC1 and DC2.

At next step 903, the CPU 101 displays a channel strip screen (301 in FIG. 3) to display information related to the respective channels of AC(0) to AC(15) on the display 105. In particular, as a region to display values of parameters allocated to the knob 311 at the present time (in a form to indicate that those parameters are allocated to the knob 311) is provided in the displayed channel strip screen, the CPU 101 displays one parameter of AC(0) to AC(15) indicated by the parameter table PT(SMP) in the region.

Note that as the parameter table PT, a parameter table PT corresponding to the genre designated with the button group 306 at that time is used. SMP is set at a value to specify the parameter allocated by the user to the knob 311 from the parameters of the genre.

Further, although the allocation of channels to sixteen channel strips 303 using a layer is described here, it is not necessary to use a layer in this allocation. For example, the allocation may be arranged such that the correspondence between a channel strip and a channel can be shifted by one channel or plural channels like scrolling. Further, the allocation may be arranged such that the user can independently allocate an arbitrary channel to an arbitrary channel strip using an arbitrary user interface.

FIG. 9B is a flow of processing upon operation of the fader 315.

Assuming that i is an integer from 0 to 15, and *=i+1 holds, when the CPU 101 detects that the fader 315-* of the channel strip 303-* (i.e., the fader of the *-th channel strip) has been operated, it starts the present processing.

In this processing, at step 911, the CPU 101 adjusts fader value of a channel having an ID of AC(i) (generally the volume level of the channel) in correspondence with an operation position of the fader.

The above processing in FIGS. 9 (*a*) and (*b*) is processing corresponding to function of a channel parameter adjustor.

Figure 10:
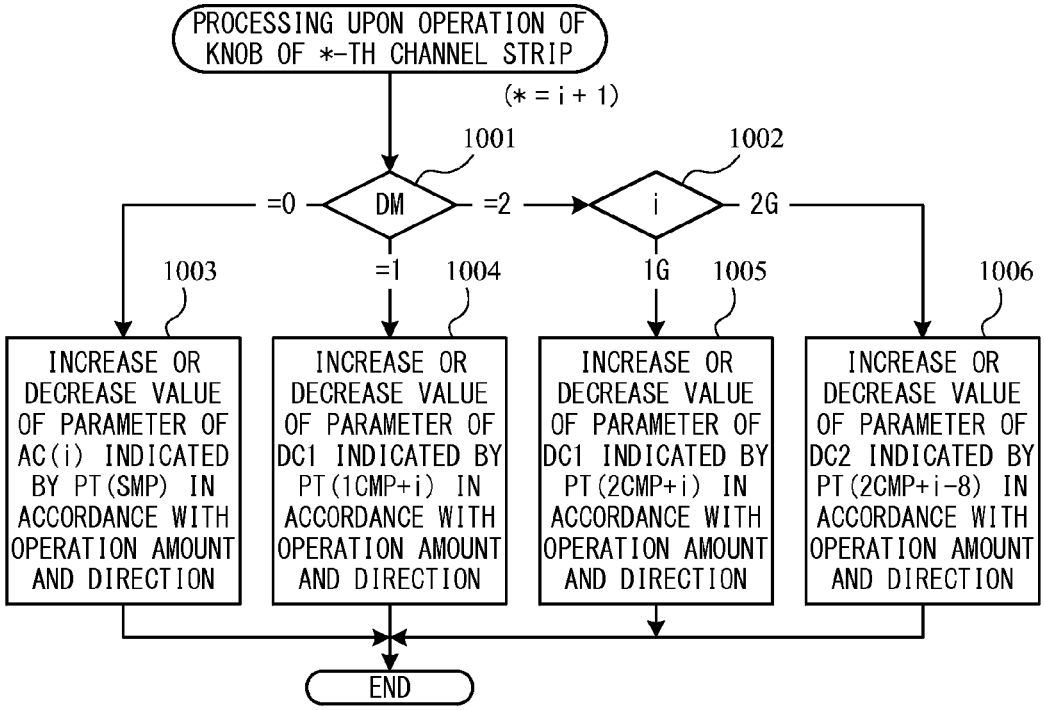
FIG. 10 is a flowchart showing processing when a knob 311 is operated.

FIG. 10 is a flow showing processing when the knob 311 of any channel strip is operated.

When the CPU 101 detects that the knob 311-* of the channel strip 303-* (i.e., the knob of the *-th channel strip) has been operated, it starts the present processing.

In this processing, first at step 1001, the CPU 101 discriminates DM.

Then, when DM=0 holds i.e. it is in the channel strip mode, the CPU 101 adjusts value of a parameter specified by the parameter ID of PT(SMP) for a channel having the ID of AC(i), in correspondence with operation amount and direction of the operated knob 311, at step 1003.

The processing at step 1003 is processing corresponding to function of a second parameter adjustor, together with processing at step 1118 in FIG. 11B described later.

Further, when DM=1 holds i.e. it is in the one-channel mode, the CPU 101 adjusts value of a parameter specified by the parameter ID of PT(1CMP+i) for a channel having the ID of DC1, in correspondence with operation amount and direction of the operated knob 311, at step 1004.

The processing at step 1004 is processing corresponding to function of a third parameter adjustor, together with processing at step 1115 in FIG. 11B described later.

When DM=2 holds i.e. it is in the two-channel mode, the CPU 101 discriminates the value of i specifying the operated knob at step 102.

Then, when $0 \leq i \leq 7$ holds (i.e., the operated knob is one of the knobs 311-1 to 311-8, and parameter adjustment corresponding to the editing object channel in the left screen of the two-channel screen is designated: this is assumed to be designation to a channel in a first group, and it is described as "1G"), the CPU 101 adjusts value of the parameter specified by a parameter ID of PT(2CMP+i) for a channel having the ID of DC1, in correspondence with operation amount and direction of the operated knob 311, at step 1005.

When $8 \leq i \leq 15$ holds (i.e., the operated knob is one of the knobs 311-9 to 311-16, and parameter adjustment with respect to the editing object channel in the right screen of the two-channel screen is designated: this is assumed to be designation to a channel in a second group, and it is described as "2G"), the CPU 101 adjusts value of the parameter specified by the parameter ID of PT(2CMP+i−8) for a channel having the ID of DC2, in correspondence with operation amount and direction of the operated knob 311, at step 1006.

The processing at these steps 1002, 1005 and 1006 is processing corresponding to function of a first parameter adjustor, together with processing at step 1122 in FIG. 11B described later.

Figure 11A:
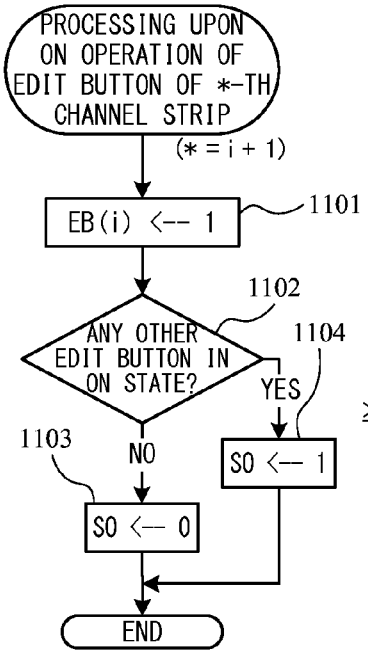
FIG. 11A is a flowchart showing processing when on operation (depression) is performed on an edit button 312.

FIG. 11A is a flow showing processing when the edit button 312 of one channel strip is operated to be ON (depressed).

When the CPU 101 detects that the edit button 312-* of the channel strip 303-* (i.e., the edit button of the *-th channel strip) has been operated to be ON, it starts the present processing.

In this processing, first at step 1101, the CPU 101 sets EB(i) at 1. Next, at step 1102, it determines whether or not there is any other edit button in ON state. This determination is made by determining whether or not there is any channel strip having a status flag EB of 1 other than the channel strip specified by the current i. When there are no other edit buttons in ON state, the CPU 101 sets the simultaneous operation flag SO at 0 at step 1103. When there is another edit button in ON state, it sets the simultaneous operation flag SO at 1 at step 1104.

Figure 11B:
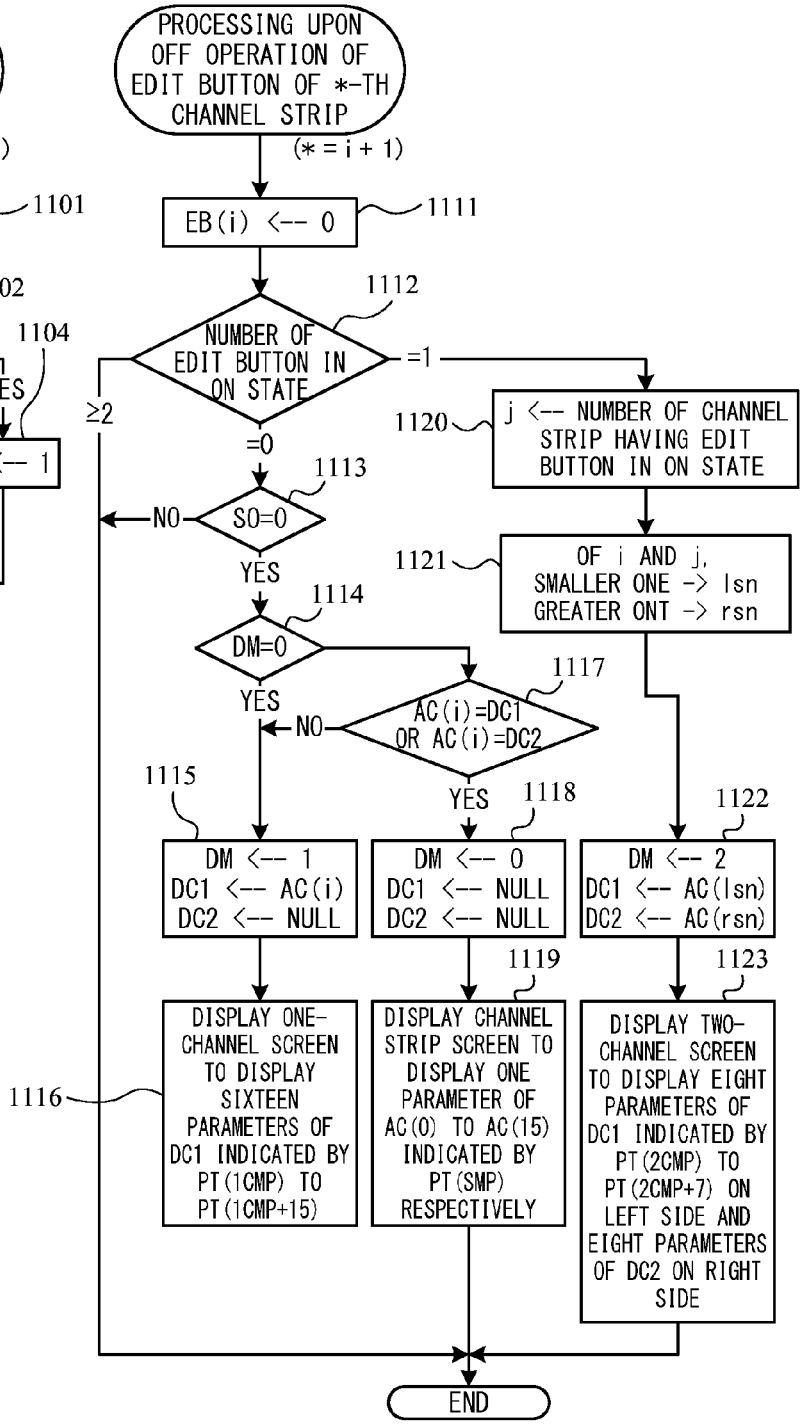
FIG. 11B is a flowchart showing processing when off operation is performed on an edit button 312.

FIG. 11B is a flow showing processing when the edit button 312 of any one channel strip is operated to be OFF (released after being depressed).

When the CPU 101 detects that the edit button 312-* of the channel strip 303-* (i.e., the edit button of the *-th channel strip) has been operated to be OFF, it starts the present processing.

In this processing, first at step 1111, the CPU 101 resets EB (i) to 0.

Next, at step 1112, it determines the number of edit buttons in ON state. This determination is made by checking EBs of all the channel strips. When the number of edit buttons in ON state is more than two, as two channels to open the two-channel screen cannot not be specified, the processing is terminated.

When the number of edit buttons in ON state is 0, it means that the edit button which has been just turned off is the last-turned-off edit button. Here, the CPU 101 checks the simultaneous operation flag SO at step 1113, and when SO≠0 holds, as a display has already been produced, terminates the processing.

When SO=0 holds, the CPU 101 checks DM at step 1114, and when the current mode is the channel strip mode, it sets DM at 1 to shift to the one-channel mode at step 1115, respectively sets DC1 at AC(i), DC2 at null, and further turns on the edit button 312 of the channel strip 303-* to which the channel of AC(i) is allocated, and turns off the other edit buttons 312.

Next, at step 1116, the CPU 101 displays the one-channel screen which sequentially displays values of sixteen parameters of the channel DC1 specified by respective parameter IDs in the parameter tables PT(1CMP) to PT(1CMP+15) in the regions 612-1 to 621-16, on the display 105, and terminates the processing.

On the other hand, at step 1114, when the current mode is other than the channel strip mode, since the one-channel screen or the two-channel screen has already been displayed, then at step 1117, the CPU 101 determines whether or not the editing object channel (DC1, DC2) of the currently-displayed one-channel or two-channel screen coincides with the channel (AC(i)) the edit button of which has just been operated to be OFF. When they do not coincides with each other, it is determined that the one-channel screen with the channel of AC(i) the edit button of which has just been operated to bf OFF, as the editing object channel, is to be displayed, then the process proceeds to step 1115.

At step 1117, when the editing object channel (DC1, DC2) of the currently-displayed one-channel screen or two-channel screen coincides with the channel (AC(i)) the edit button of which has just been operated to be OFF, the CPU 101 interprets the operation as an instruction to close the currently-displayed one-channel screen or two-channel screen, then at step 1118, sets DM at 0, sets DC1 and DC2 at null, and turns off the edit buttons 312 of all the channel strips 303.

Next, at step 1119, the CPU 101 displays a channel strip screen (301 in FIG. 3) to display information related to the respective channels of AC(0) to AC(15) on the display 105. At this time, one parameter of AC(0) to AC(15) indicated by the parameter table PT(SMP) is respectively displayed on the display region of a parameter allocated to the knob 311 in the channel strip screen.

Further, at step 1112, when the number of edit buttons in ON state is 1, since one edit button has been turned off from a status where two edit buttons were in ON state, a two-channel screen is to be opened, and the process proceeds to step 1120.

At step 1120, the CPU 101 stores the number of the channel strip 303 having a currently ON-state edit button (a number counted from the leftmost channel strip as 0, then the next channel strip on the right as 1, then sequentially 2, 3, . . . to the right side, to the rightmost channel strip as 15) into a variable j.

Next, at step 1121, the CPU 101 stores smaller one of i which specifies a channel strip having a just-turned-off edit button and j which specifies a currently-ON-state channel strip into the variable lsn, and stores the greater one into the variable rsn, respectively.

Next, at step 1122, the CPU 101 stores 2 into DM, AC(lsn) into DC1, AC(rsn) into DC2, respectively, and further, turns on the edit buttons 312 of the two channel strips 303-l*, 303-r* (note that l*=lsn+1 and r*=rsn+1) to which the two channels of AC(lsn) and AC(rsn) are allocated, and turns off the other edit buttons 312.

Further, at step 1123, the CPU 101 displays the two-channel screen having a left screen to sequentially display values of eight parameters of the channel DC1 specified by respective parameter IDs of PT(2CMP) to PT(2CMP+7) in the parameter table in regions 712-1 to 712-8, and a right screen to sequentially display values of eight parameters of the channel DC2 specified by respective parameter IDs of PT(2CMP) to PT(2CMP+7) in the parameter table in regions 722-1 to 722-8, on the display 105, then terminates the processing.

Note that it may be arranged such that when a page designation is made with the button group 305 in a status where the one-channel screen or the two-channel screen is displayed on the display 105, 1CMP or 2CMP is changed in correspondence with the designated page p, and the one-channel screen or the two-channel screen is re-displayed in the processing at step 1116 or 1123. Further, it may be arranged such that when genre change is made with the button group 306 in a status where the one-channel screen or the two-channel screen is displayed on the display 105, the page p is initialized to 1, then 1CMP or 2CMP is changed in correspondence with the designated page p, and the one-channel screen or the two-channel screen is re-displayed using parameter table PT of a newly designated genre in the processing at step 1116 or 1123.

According to the above-described digital mixer 100, it is possible to selectively open one screen of a desired type among the channel strip screen, the one-channel screen and the two-channel screen, in which a desired channel is a control object, and to edit parameters of the channel, with a simple operation of the edit button prepared in each channel strip. In particular, in a two-channel screen, it is possible to adjust values of parameters of arbitrary two channels while comparing them with each other.

The explanation of the embodiment as described above is terminated. Particular device configuration, screen structure, particular steps of the processing, data format and the like are not limited to those described in the above-described embodiment.

For example, in the screen explained in the above-described embodiment, its displayed content, size, position and the like may be arbitrarily changed.

Further, it is conceivable that as a screen having the same purpose of the two-channel screen, a screen to simultaneously display designated types of parameters of designated three or more channels and edit the parameters while comparing them with each other, is provided. In this case, the sixteen channel strips 303-1 to 303-16 may be divided into groups in correspondence with the number of channels (when three channels are selected, three groups) selected by the user as editing objects with the edit buttons 312 and the like.

Then, each channel selected as the editing object may be corresponded to each group, and parameter value of corresponding channel may be adjusted with the knob 311 of the channel strip 303 of each group. Note that in this case, the correspondence between the edit buttons 312 and the channel is not changed.

Note that the number of groups is an arbitrary number. It is conceivable that, assuming that M is an integer of 1 or greater; N is an integer of 2 or greater; and N>M holds, when M channels are selected as editing objects, N channel strips are divided into M groups and then selected M channels are corresponded to these groups respectively.

Further, in the two-channel screen or the above-described screen to display and edit parameters for three or more channels, the number of channel strips 303 (particularly, knobs 311) allocated to respective channels as editing objects and used for editing the parameters of the channels need not be equal.

That is, e.g., in the left screen 701 and the right screen 702 of the two-channel screen, the ratio of the numbers of channels included in the screens may be 1:2. More generally, it is conceivable that, assuming that m and n are respectively integers of 2 or greater, m pieces of m+n channel strips provided in the channel strip module are included in the first channel strip group, and n pieces are included in the second channel strip group. The other ratios are of course available.

Width of the each display region corresponding to the editing object channels (in the case of the two-channel screen, the left screen 701 and the right screen 702) may be a width according to the number of channel strips in the corresponding group of channel strips.

The selection of editing object channels is not limited to that in the above-described embodiment. For example, it is conceivable that a channel corresponding to an operated edit button 312 is sequentially added to editing object channels. For example, when an edit button 312 corresponding to the first input channel is operated in the channel strip mode, the mode shifts to the one-channel mode with the first input channel as an editing object channel, and thereafter, when an edit button 312 corresponding to the second input channel is operated, the mode shifts to the one-channel mode with the second input channel in addition to the first input channel as editing object channels. It is conceivable, when three or more channels are selectable as editing object channels, that also the third channel is similarly selected and a three-channel screen divided into three is displayed.

Further, it is preferable that release of selection of editing object channel can be performed by re-operating the edit button 312 corresponding to the selected channel. For example, in the above-described two-channel mode, when the edit button 312 corresponding to the second input channel is operated, the selection of the second input channel is released, and the mode shifts to the one-channel mode with the first input channel as an editing object channel.

Further, it is also conceivable that when plural edit buttons 312 are simultaneously operated, the channels corresponding to those buttons are additionally selected or selection-released at once.

Otherwise, it is conceivable that as in the case of the above-described example, while the channel corresponding to the operated edit button 312 is sequentially added to the editing object channels, the number of simultaneously selectable channels is limited, and the editing object channels are selected giving priority to later selection.

In this case, for example, when the respective edit buttons 312 corresponding to the first to fourth input channels are operated in this order from the status of the channel strip mode, assuming that the limit of the number of simultaneously selectable channels is two, the mode shifts in the following order from a) to d).

a) one-channel mode with the first input channel as an editing object channel b) two-channel mode with the first and second input channels as editing object channels c) two-channel mode with the second and third input channels as editing object channels d) two-channel mode with the third and fourth input channels as editing object channels Note that when this method is employed, it is preferable that the channel selection release can be performed by the re-operation of the edit button 312.

Further, the selection may be made not giving priority to later selection but giving priority to first selection. Here, assuming that the operation same as the above example is performed, the mode shifts in the following order from e) to h).

e) one-channel mode with the first input channel as an editing object channel f) two-channel mode with the first and second input channels as editing object channels g) two-channel mode with the first and third input channels as editing object channels h) two-channel mode with the first and fourth input channels as editing object channels This may be considered as a method of fixedly handling the first selected channel and sequentially changing the secondly and subsequently selected channel.

The selection of editing object channel is not limited to these methods but an arbitrary method is available.

Further, in addition to the above points, the positional relation between the edit button 312 (selection control) and the knob 311 (setting control) is not limited to that shown in FIG. 3. They may be in positions away from each other. They may be in different sections on the operation panel.

Further, the number of the channel strips 303 is not limited to sixteen but may be an arbitrary number.

Further, it is conceivable that if one channel strip 303 has plural controls (knobs, sliders, buttons and the like) other than the edit buttons 312, parameters of editing object channels can be allocated to one or plurality of those controls as in the case of the knobs 311, and those controls are used for adjustment of parameter values of the allocated parameters.

Although it is conceivable that similar allocation is enabled also regarding the editing button 312, such configuration is not preferable since further controls to release channel selection are required in this configuration.

Further, in the above-described embodiment, assignment of parameter to the knob 311 of each channel strip 303 is made in the form of PT(SMP) via parameter table PT. However, a parameter ID may be directly assigned to each knob 311.

More particularly, it is conceivable that a variable SMPID (Strip Mode Parameter ID) is prepared in place of SMP, the ID of the parameter assigned to the knob 311 is stored into the variable SMPID. In FIG. 10, at step 1003, the CPU 101 increases or decreases value of the parameter of a channel having ID of AC(i), specified by the parameter ID indicated by the variable SMPID. Here, it is possible to assign a desired parameter to the knob 311 regardless of genre selected with the button 306.

Further, in the above-described embodiment, as shown in FIG. 2, the invention is applied to a system having a mixer and an external display unit. However, the invention is applicable to various types of audio signal processing devices such as a recorder or an effector to perform processing on audio signals in plural channels.

Further, the invention may be applied to an audio signal processing device having a combination of a DAW (e.g.

Cubase (registered trademark) or Nuendo (registered trademark)) which operates on an OS of a PC and a control surface or a physical controller connected to the PC as a user interface of the DAW.

Figure 12:
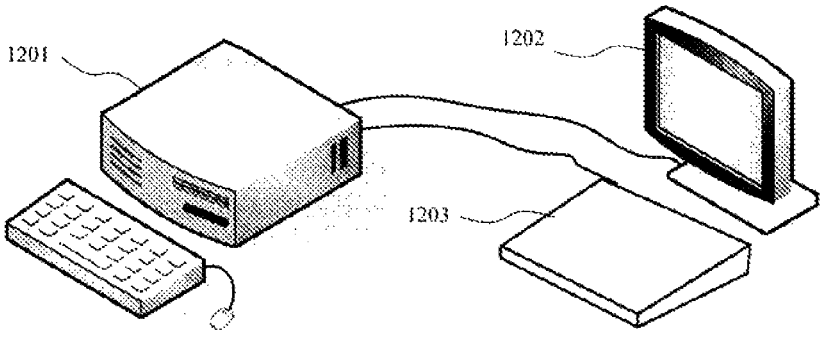
FIG. 12 is a diagram illustrating an example of configuration when a DAW is operated on a PC, and an external display and a control surface are connected to the PC.

FIG. 12 illustrates an example of configuration where a DAW is operated on a PC 1201 having a pointing device such as a mouse (a display is not required on the PC 1201 side since there is an external display 1202), and the external display 1202 and a control surface 1203 are connected to the PC 1201.

As it is well known, a DAW which operates on the PC 1201 has an audio recorder function in plural tracks, a MIDI sequencer function in plural tracks, an audio mixer function having plural input channels, plural buses and plural output channels, and the like. The combination between the control surface and the audio mixer function of the DAW is approximately equivalent to the mixer 100.

In this case, it is conceivable that, assuming that the moving fader 107 and the controls 108 in FIG. 1 correspond to the control surface 1203, and the other elements in FIG. 1 correspond to the DAW operating on the PC 1201, a program to realize the operation as described above is incorporated in the DAW.

Further, the display 105 may be a touch display. In this case, it is conceivable that the user can assign a desired parameter to the knob 311 by touching the parameter displayed on the channel strip screen 321.

Further, it is also conceivable that a touch display is employed as the operation panel 201, and the functions of the channel strip 303 and the various controls are realized with software. A tablet type computer in which an application to realize functions of such operation panel 201 is installed may be used as the operation panel 201.

Further, the hardware configuration shown in FIG. 1 and FIG. 2 is merely an example and may be arbitrarily modified. The operation panel 201 and the display 105 may be integrated. Further, the display 105 may be incorporated in the mixer 100.

The internal configuration of the mixer 100 is not limited to that shown in FIG. 1. For example, the flash memory 102 and the RAM 103 may not be physically different units. It is not necessary to discriminate them from each other. Further, a storage corresponding to the flash memory 102 may be provided outside the mixer 100. The devices such as the CPU 101, various interfaces and memories may be appropriately integrated in one package. In place of the moving fader 107, a control such as a slider without driver may be used as a fader.

Further, the EQ 503 may be a parametric equalizer having a different parameter structure from that of a graphic equalizer.

Further, in the above-described embodiment, the one-channel screen 601 and the two-channel screen 700 are pop-up displayed, however, the entire or a part of the screen may be replaced with the one-channel screen 601 or the two-channel screen 700 not popping-up the screen. Further, these screens may be displayed in other methods.

Further, the various devices or their constituent elements described in the above-described embodiment or modifications may be connected via a LAN (Local Area Network) or the Internet. These various devices or their constituent elements may be corporeal hardware or virtual machines. They may be realized as services provided from a remote host (server) except elements such as various controls directly operated by the user.

Further, it is possible to combine the configurations of the above-described embodiment and modifications for implementation as long as no contradiction arises.

Further, in addition to the above description, the invention can be implemented at least in the following forms (A) to (D).

(A): An audio signal processing device including: channel processors of 2n channels that perform signal processing to control sound characteristic on respective audio signals in 2n channels (note that n is an integer); a current memory storing a plurality of parameters to control the above-described signal processing with respect to each of the channel processors of 2n channels; a display unit; first and second channel strip modules in the vicinity of the display unit and in positions opposite to an operator with respect to the display unit, n channels of the 2×n channels being correspond to n channel strips of the first channel strip module while remaining n channels being correspond to n channel strips of the second channel strip module, and each channel strip including at least one knob and one edit button; and a controller that controls the device, wherein the display unit selectively displays one of a channel strip screen to display parameters of the 2n channels, a one-channel screen to display 2n parameters of any one channel and a two-channel screen to display respective n parameters of any two channels, and wherein (1) when the channel strip screen to display parameters of the 2n channels is displayed on the display unit, the controller allocates one parameter of the respective channels to the above-described knobs of the respective channel strips of the first or second channel strip module corresponding to the channel; in accordance with an operation of the knob of one channel strip corresponding to any one channel, increases or decreases a value of the parameter allocated to the knob among the parameters of the channel stored in the current memory; in accordance with a singular operation of the edit button of one channel strip corresponding to any one channel, controls the display unit to display the one-channel screen to display 2n parameters of the one channel; and in accordance with a simultaneous operation of the edit buttons of two channels strips corresponding to any two channels, controls the display unit to display the two-channel screen to display the respective n parameters for the two channels, (2) when the one-channel screen to display 2n parameters for one channel is displayed on the display unit, allocates the 2n parameters of the one channel to the knobs of total 2n channel strips of the first and second channel strip modules; in accordance with an operation of the knob of the respective channel strips, increases or decreases value of the parameter allocated to the knob among the parameters of the one channel stored in the current memory; in accordance with a simultaneous operation of the edit buttons of two channel strips corresponding to any two channels, controls the display unit to display the two-channel screen to display respective n parameters of the two channels; in accordance with an operation of the edit button of the channel strip corresponding to the one channel, controls the display unit to display the channel strip screen to display parameters of the 2n channels; and (3) when the two-channel screen to display respective n parameters of some two channels is displayed on the display unit, respectively allocates n parameters of one channel of the some two channels to the knobs of the n channel strips of the first channel strip module, and allocates n parameters of the other channel to the knobs of the n channels strips of the second channel strip module; in accordance with an operation of the knob of the respective channel strips of the first channel strip module, increases or decreases a value of the parameter allocated to the knob among the parameters of the one channel stored in the current memory; in accordance with an operation of the knob of the respective channel strips of the second channel strip module, increases or decreases a value of the parameter allocated to the knob among the parameters of the other channel stored in the current memory; in accordance with an operation of the edit button of the channel strip corresponding to any one channel other than the some two channels, controls the display unit to display the one-channel screen to display 2n parameters of the one channel; and in accordance with an operation of the edit button of the channel strip corresponding to any one of the some two channels, controls the display unit to display the channel strip screen to display parameters for the 2n channels.

(B): In the audio signal processing device described in (A), wherein (2) when the one-channel screen to display 2n parameters of one channel is displayed on the display unit, the controller controls the display unit, in accordance with an operation of the edit button of the channel strip corresponding to any one channel other than the one channel, to display the one-channel screen to display 2n parameters for the any one channel.

(C) In the audio signal processing device described in (A), wherein (3) when the two-channel screen to display respective n parameters of some two channels is displayed on the display unit, the controller controls the display unit, in correspondence with a simultaneous operation of the edit buttons of two channel strips corresponding to any two channels, to display the two-channel screen to display respective n parameters of the any two channels.

(D) An audio signal processing device including: channel processors of a plurality of channels that perform signal processing with respect to a plurality of audio signals based on parameters stored by channel in a current memory; a display unit; a channel strip module having a plurality of channel strips, one channel strip having controls including at least one knob and one edit button, channels of the channel processors being allocated to the respective channel strips, parameters for the channels allocated to the channel strips being adjusted by operating the control of the channel strips, and the plurality of channel strips being divided into a first group and a second group; and a controller, wherein the display unit selectively displays one of a channel strip screen to display a list of setting statuses of parameters of all the channels allocated to the plurality of channel strips of the channel strip module, a one-channel screen to display a plurality of parameters of any one channel, and a two-channel screen to display respective pluralities of parameters of any two channels, and wherein (1) when the channel strip screen is displayed on the display unit, the controller allocates one parameter of respective channels to the knob of the respective channel strips of the channel strip module; increases or decreases a value of the allocated parameter in accordance with an operation of the knob; in accordance with a singular operation of the edit button of any one channel strip, controls the display unit to display the one-channel screen to display a plurality of parameters of one channel allocated to the channel strip; in accordance with a simultaneous operation of the edit buttons of any two channel strips, controls the display unit to display the two-channel screen to display respective pluralities of parameters for two channels allocated to the channel strips, (2) when the one-channel screen is displayed on the display unit, the controller allocates each of the plurality of parameters of the one channel displayed on the one-channel screen to the knobs of the respective channel strips of the channel strip module; increases or decreases a value of the allocated parameter in accordance with an operation of the knob; in accordance with an operation of the edit button of the channel strip to which the one channel displayed on the one-channel screen is allocated, controls the display unit to display the channel strip screen; in accordance with a simultaneous operation of the edit buttons of any two channel strips, controls the display unit to display the two-channel screen to display respective pluralities of parameters of two channels allocated to the channel strips, and (3) when the two-channel screen is displayed on the display unit, the controller allocates each of a plurality of parameters of one channel of the two channels displayed on the two-channel screen to the knobs of the respective channel strips of the first group of the channel strip module, and increases or decreases a value of the allocated parameter in accordance with an operation of the knob; allocates each of a plurality of parameters of the other channel of the two channels displayed on the two-channel screen to the knobs of the respective channel strips of the second group of the channel strip module, and increases or decreases a value of the allocated parameter in accordance with an operation of the knob; in accordance with an operation of any edit button of the channel strips to which the two channels displayed on the two-channel screen are allocated, controls the display unit to display the channel strip screen; and in accordance with a singular operation of the edit button of any one channel strip other than the channel strips to which the two channels displayed on the two-channel screen are allocated, controls the display unit to display the one-channel screen to display the plurality of parameters of one channel allocated to the channel strip.

This application is based upon and claims the benefit of priority from the prior Japanese Patent Application (Patent Application No. 2011-253370), filed on Nov. 19, 2011, the entire contents of which are incorporated herein by reference.

REFERENCE SIGNS LIST

101 . . . Central Processing Unit (CPU), 102 . . . flash memory, 103 . . . RAM (Random Access Memory), 104 . . . display I/O, 105 . . . external display unit (display), 106 . . . other I/O, 107 . . . moving fader, 108 . . . controls, 109 . . . waveform I/O, 110 . . . signal processor (DSP), 120 . . . bus line.

The invention claimed is:

1. An audio signal processing device comprising:

a channel processor having a plurality of channels each of which performs signal processing on an audio signal based on a value of a parameter by channel;

a channel strip module having a plurality of channel strips, one channel strip having controls including at least one setting control and one edit button, and the plurality of channel strips being divided into a first group and a second group;

a channel parameter adjustor for allocating any of the channels of the channel processor to the respective channel strips of the channel strip module, and adjusting, in accordance with an operation of a control other than the setting control and the edit button of the channel strip, a value of a parameter of a channel allocated to the channel strip;

a first display controller for, in accordance with operations of the edit buttons of any two channel strips, controlling a predetermined display to display a two-channel screen to display respective pluralities of parameters of two channels allocated to the two channel strips;

a first parameter adjustor for allocating each of a plurality of parameters of one channel of the two channels displayed on the two-channel screen to the setting controls of the respective channel strips of the first group of the channel strip module, allocating each of a plurality of parameters of another channel of the two channels displayed on the two-channel screen to the setting controls of the respective channel strips of the second group of the channel strip module, and adjusting values of the parameters allocated to the respective setting controls in accordance with operations on the respective setting controls;

a third display controller for, in accordance with an operation of the edit button of any one channel strip, controlling the display to display a one-channel screen to display a plurality of parameters of one channel allocated to the one channel strip; and a third parameter adjustor for allocating each of a plurality of parameters of the one channel displayed on the one-channel screen to the setting controls of the respective channel strips of the first and second groups of the channel strip module, and adjusting values of the parameters allocated to the respective setting controls in accordance with operations of the respective setting controls.

2. The audio signal processing device according to claim 1, further comprising:

a second display controller for, when the two-channel screen is displayed on the display, in accordance with an operation of the edit button of one of the two channel strips to which the two channels displayed on the two-channel screen are allocated, controlling the display to display a channel strip screen to display parameters for all the channels allocated to the plurality of channel strips of the channel strip module; and a second parameter adjustor for, when the channel strip screen is displayed, in accordance with channel allocation by the channel parameter adjustor, allocating one parameter of all the channels allocated to the respective channel strips to the setting controls of the respective channel strips of the channel strip module, and adjusting values of the parameters allocated to the respective setting controls in accordance with operations of the respective setting controls.

3. The audio signal processing device according to claim 1, wherein the third display controller displays the one-channel screen, in accordance with an operation of the edit button of any one channel strip other than the two channel strips to which the two channels displayed on the two-channel screen are allocated, when the two-channel screen is displayed on the display.

4. The audio signal processing device according to claim 1, wherein m and n are respectively an integer of 2 or greater, and wherein the channel strip module includes a first channel strip section having m channel strips of the first group and a second channel strip section having n channel strips of the second group, wherein when the two-channel screen is displayed on the display, the first parameter adjustor allocates m parameters for the one channel of the two channels displayed on the two-channel screen to the setting controls of the respective channel strips of the first channel strip section, and allocates n parameters of the another channel to the setting controls of the respective channel strips of the second channel strip section, and wherein when the one-channel screen is displayed on the display, the third parameter adjustor allocates m+n parameters of the one channel displayed on the one-channel screen to the setting controls of the respective channel strips of the channel strip module.

5. A parameter adjusting method in which an audio signal processing device comprising: a channel processor having a plurality of channels each of which performs signal processing on an audio signal based on a value of a parameter by channel; and a channel strip module having a plurality of channel strips, one channel strip having controls including at least one setting control and one edit button, the plurality of channel strips being divided into a first group and a second group, executes:

a channel parameter adjusting process of allocating any of channels of the channel processor to the respective channel strips of the channel strip module, and adjusting, in accordance with an operation of a control other than the setting control and the edit button of the channel strip, a value of a parameter of a channel allocated to the channel strip;

a first display control process of, in accordance with operations of edit buttons of any two channel strips, controlling a predetermined display to display a two-channel screen to display respective pluralities of parameters of two channels allocated to the two channel strips;

a first parameter adjusting process of allocating each of a plurality of parameters of one channel of the two channels displayed on the two-channel screen to the setting controls of respective channel strips of the first group of the channel strip module, allocating each of a plurality of parameters of another channel of the two channels displayed on the two-channel screen to the setting controls of the respective channel strips of the second group of the channel strip module, and adjusting values of the parameters allocated to the respective setting controls in accordance with operations of the respective setting controls;

a third display control process of, in accordance with an operation of the edit button of any one channel strip, controlling the display to display a one-channel screen to display a plurality of parameters of one channel allocated to the one channel strip; and a third parameter adjusting process of allocating each of a plurality of parameters for the one channel displayed on the one-channel screen to the setting controls of the respective channel strips of the first and second groups of the channel strip module, and adjusting values of the parameters allocated to the respective setting controls in accordance with operations of the respective setting controls.

6. An audio signal processing device for processing audio signals in a plurality of channels, comprising:

a plurality of channel strips respectively having a selection control and a setting control, to each of which one of the channels can be allocated;

a selector for, in accordance with an operation of the selection control of one or a plurality of channel strips, selecting one or a plurality of channels allocated to the one or the plurality of channel strips; and a first parameter adjustor for allocating respective pluralities of parameters of the one or the plurality of channels selected by the selector to the setting controls of the plurality of channel strips, respectively, and adjusting values of the parameters allocated to the respective setting controls in accordance with operations of the respective setting controls, wherein the channels selected by the selector in accordance with the operation of the respective selection controls are not changed before and after parameter allocation by the first parameter adjustor, wherein M is an integer of 1 or greater, N is an integer of 2 or greater, and N>M holds, wherein N channel strips are provided, and wherein when the selector selects M channels, the first parameter adjustor divides the N channel strips into M groups and respectively sets correspondence between the M channels and the M groups, and regarding the respective groups, allocates, to the setting controls of respective channel strips belonging to the group, as many parameters of a channel corresponding to the group as number of the setting controls, at least in cases of M is 1 and M is 2.

7. The audio signal processing device according to claim 6, further comprising:

a releasing device for releasing channel selection by the selector; and a second parameter adjustor for, when the channel selection is released by the releasing device, allocating parameters of the channels allocated to the channel strips to the setting controls of the respective channel strips, respectively, and in accordance with operations of the respective setting controls, adjusting values of the parameters allocated to the respective setting controls.

8. The audio signal processing device according to claim 6, further comprising a display controller for, in accordance with number of channels to which the first parameter adjustor has allocated the parameters, displaying information related to the respective channels on a predetermined display.

9. The audio signal processing device according to claim 8, wherein the display controller has a device for displaying, in a screen displayed on the display, information related to a parameter allocated to the setting control, in a position corresponding to the respective setting controls in an array direction of the channel strips.

10. A parameter adjusting method in which an audio signal processing device for processing audio signals in a plurality of channels, comprising: a plurality of channel strips respectively having a selection control and a setting control, to each of which one of the channels can be allocated, executes:

a selecting process of, in accordance with an operation of the selection control of one or a plurality of channel strips, selecting one or a plurality of channels allocated to the one or the plurality of channel strips; and a first parameter adjusting process of allocating respective pluralities of parameters of the one or the plurality of channels selected at the selecting process to the setting control of the plurality of channel strips, respectively, and adjusting values of the parameters allocated to the respective setting controls in correspondence with operations of the respective setting controls, wherein the channels selected in the selecting process in accordance with the operation of the respective selection controls are not changed before and after parameter allocation in the first parameter adjusting process, wherein M is an integer of 1 or greater, N is an integer of 2 or greater, and N>M holds, wherein N channel strips are provided in the audio signal processing device, and wherein when M channels are selected in the selecting process, in the first parameter adjusting process, the N channel strips are divided into M groups and correspondence between the M channels and the M groups are respectively set, and regarding the respective groups, as many parameters of a channel corresponding to the group as number of the setting controls are allocated to the setting controls of respective channel strips belonging to the group, at least in cases of M is 1 and M is 2.

* * * * *